US005479747A

United States Patent [19]

Wu

[11] Patent Number: 5,479,747

[45] Date of Patent: Jan. 2, 1996

[54] CONDUIT CONNECTING MECHANISM FOR A SCREEN PANEL

[76] Inventor: Ming-Hsin Wu, 20, Lane 92, Shing Ell Street, Tao Yuan City, Tao Yuan County, Taiwan

[21] Appl. No.: 241,706

[22] Filed: May 12, 1994

[51] Int. Cl.[6] ..... E04F 17/08; H02G 3/10

[52] U.S. Cl. ..... 52/220.7; 52/239; 52/656.1; 52/656.9

[58] Field of Search ..... 52/220.7, 220.1, 52/238.1, 239, 220.8, 36.1, 656.9, 656.1; 174/48, 49, 66, 67; 160/135, 351; 439/215

[56] References Cited

U.S. PATENT DOCUMENTS 4,118,903 10/1978 Coulthard ..... 52/238.1 X
4,593,505 6/1986 Russell ..... 52/220.7
4,713,918 12/1987 Cioffi ..... 174/48 X
4,800,695 1/1989 Menchetti ..... 439/215 X
4,833,848 5/1989 Guerin ..... 52/238.1 X
4,918,886 4/1990 Benoit et al. ..... 439/215 X
5,091,607 2/1992 Stob ..... 174/48

*Primary Examiner*—Carl D. Friedman
*Assistant Examiner*—Kien T. Nguyen
*Attorney, Agent, or Firm*—Bacon & Thomas

[57] ABSTRACT

A conduit connecting mechanism includes a connecting box suitable for connecting to both ends of the conduit assembly to facilitate an easy connection. The connecting box is provided with a plurality of rectangular openings and elongate openings at frontal and sidewall for mounting a socket or routing electric cords therethrough. A lid is removably attached to each of the openings.

7 Claims, 5 Drawing Sheets

CONDUIT CONNECTING MECHANISM FOR A SCREEN PANEL

BACKGROUND OF THE INVENTION

This invention relates to a conduit connecting mechanism, more particularly, to a conduct mechanism for a screen panel. This conduit connecting mechanism facilitates a perfect connection between two adjacent conduits, for a perfect connection integrity.

The plastic screen panel has been widely used in partitioning and decorating the office. This kind of screen panel can be assembled on site to form an individual working space for each staff member. This plastic screen panel is easy to wash and clean and, accordingly, it has become widely accepted for decorating and positioning the office.

But the modern office is incorporated with many working appliances, such as the telephone, the personal computer etc. Each appliance is incorporated with a power cord or data line. As a result, some from of conduit is necessary for installing these cords and lines. This is absolute necessary because an exposed line may cause people to trip.

Because many offices have used the screen panel to partition the office, accordingly, the conduit for electric wires can be disposed below the bottom edge of the screen panel. This really solves the problem. But the connection between two adjacent screen panels must be carefully made to provide a perfect and complete connection therebetween.

On the other hand, the conduit for electric wire may be separated from the screen panel and, accordingly, when the screen panel is removed for a relocation, the conduit must be removed and installed again. Much time is lost in adjusting the conduit with respect to the screen panel.

SUMMARY OF THE INVENTION

It is the object of this invention to provide a conduit connecting mechanism for a conduit to be mounted beneath a screen panel wherein the conduit can be easily attached to the bottom edge of the screen panel.

It is still the object of this invention to provide a conduit connecting mechanism for a conduit to be mounted beneath a screen panel wherein a connecting box is provided to facilitate a perfect connection of the conduit.

In order to achieve the objects set forth, the conduit connecting mechanism made according to this invention includes a connecting box suitable for connecting to both ends of the conduit assembly to facilitate an easy connection. The connecting box is provided with a plurality of rectangular openings and elongate openings at a side wall as well as a frontal wall for mounting a socket or permitting the electric cords to pass therethrough. A lid is removably attached to each of the openings.

In an embodiment of the conduit connecting mechanism, the bottom of said connecting box is provided with a screw hole for mounting a supporting leg.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a connecting mechanism for a conduit mounted on a screen panel. In the drawings.

DETAILED DESCRIPTION OF THE PREFERRED EMBODIMENTS

Figure 1:
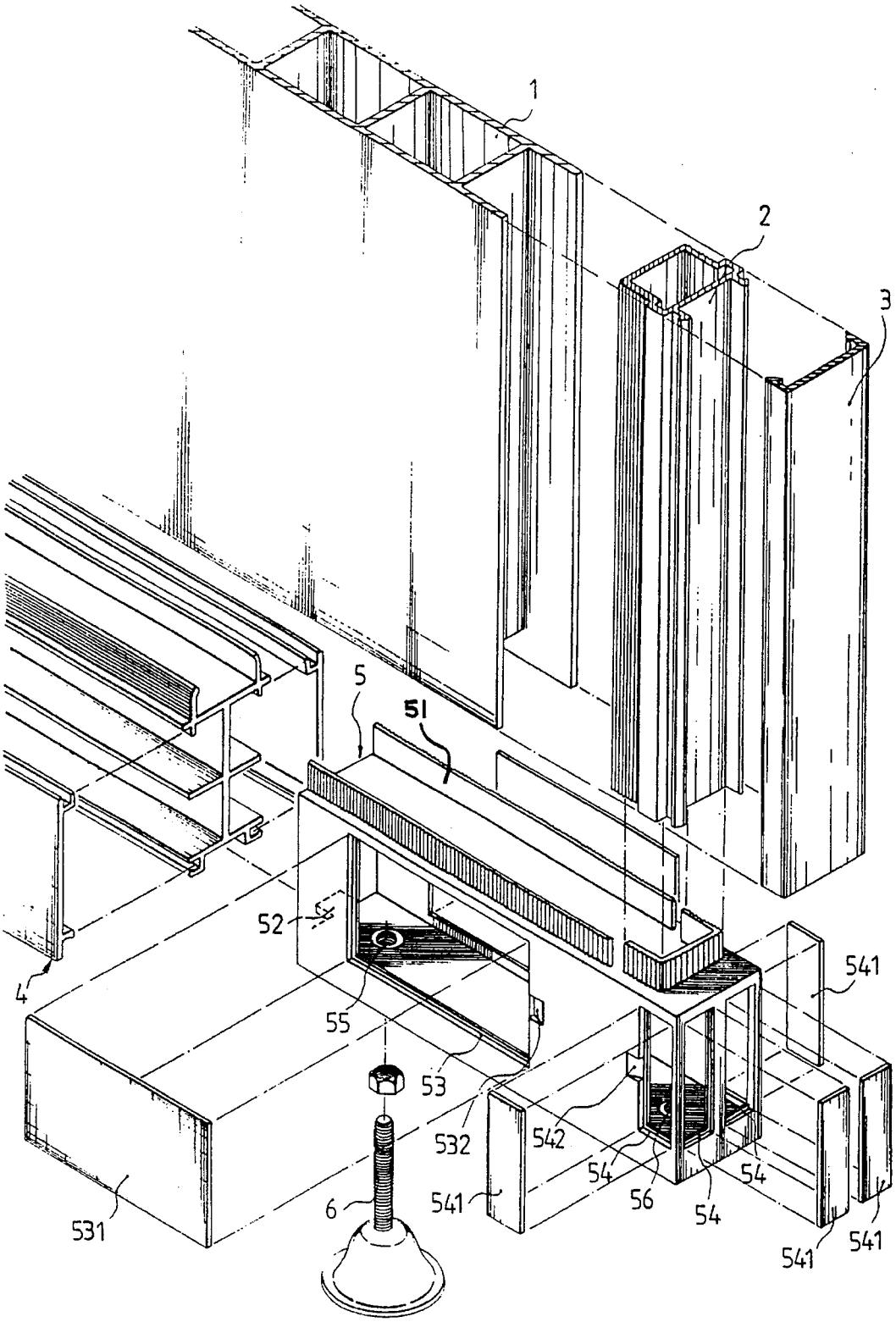
FIG. 1 is an exposed perspective view of the conduit connecting mechanism made according to this invention.

Referring to FIG. 1, the plastic screen panel 1 is used as a partitioning material. In general, the edge of the plastic screen panel 1 is covered by a trim body 2 and a band cover 3 to finish the edge smoothly and completely. At the bottom edge of the screen panel 1, a conduit assembly 4 is installed to define a plurality of slots thereof. At the end portion of the conduit assembly 4, a connecting box 5 is interconnected with said conduit assembly 4.

The connecting box 5 generally has a cubic configuration. The top surface of the connecting box 5 is provided with an insert 51 capable of being received within a chamber defined by the trim body 2 and the screen panel 1. The side walls of said connecting box 5 in the lengthwise direction are provided with rectangular horizontal openings 53 for mounting a plug socket. Said opening 53 can be covered by a lid 531 when the plug socket is not mounted. At the frontal wall and side wall adjacent to said frontal wall, a plurality of elongate vertical openings 54 are provided for the electric cords. When not being utilized for routing electric cords each elongate opening 54 can be covered by an elongate lid 541.

A screw hole 55 is provided at the bottom of the connecting box 5 for installing a supporting leg 6. Besides, a plurality of positioning holes 56 are provided for connecting plate 7.

Figure 2:
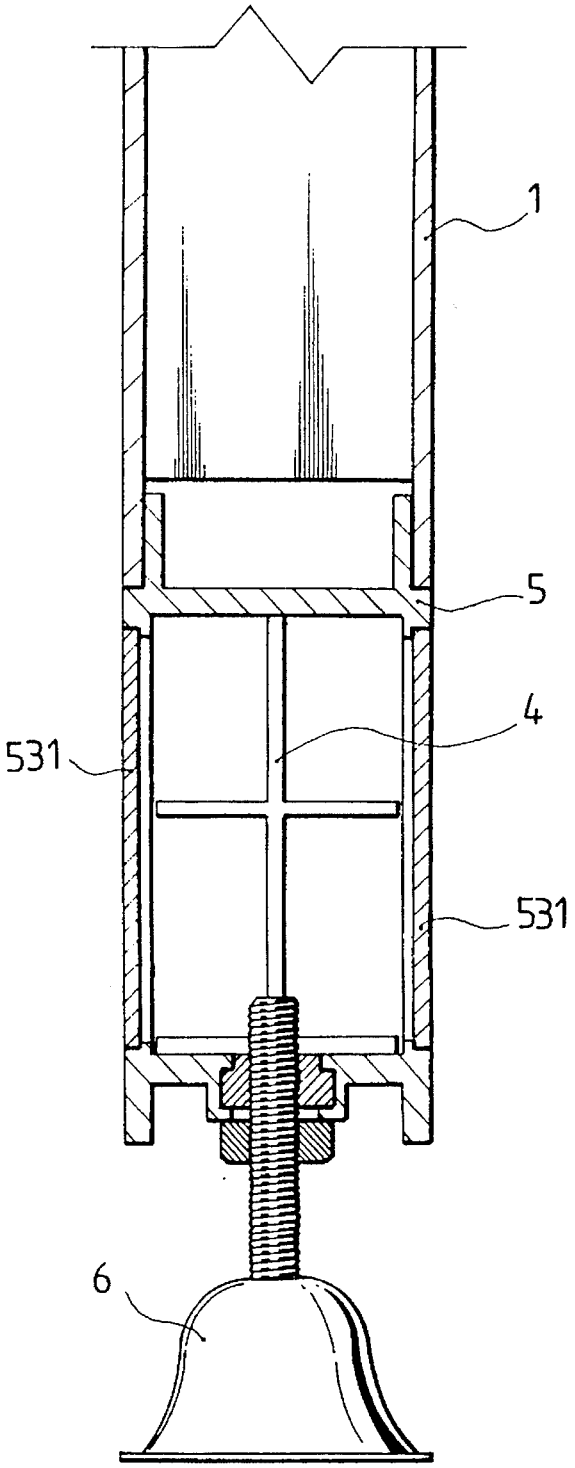
FIG. 2 is a cross sectional view of the conduit connecting mechanism made according to this invention.
Figure 3:
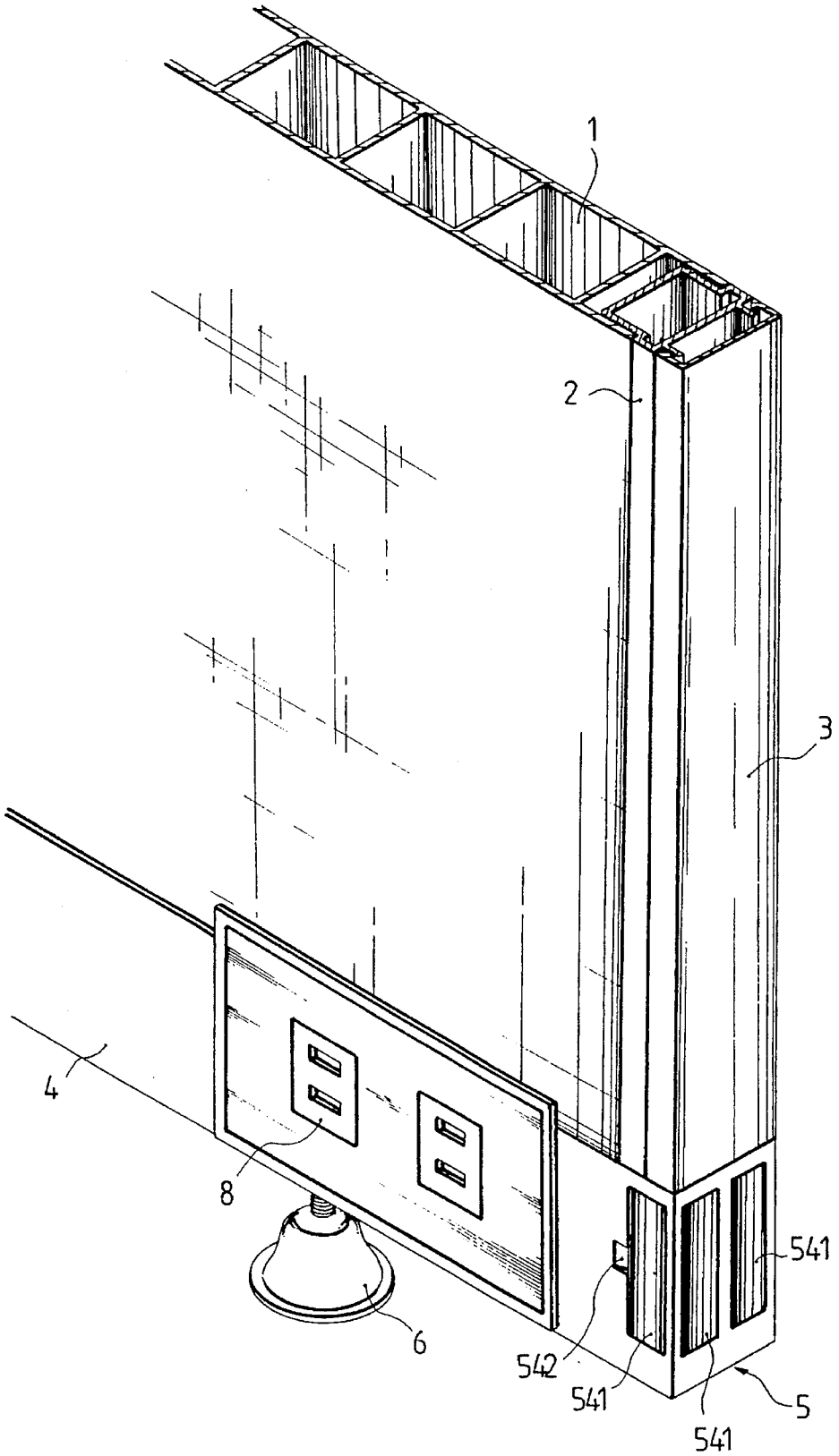
FIG. 3 is a perspective view of the conduit connecting mechanism mounted beneath a screen panel.

Referring to FIGS. 2 and 3, the connecting box 5 can be installed to the bottom of the screen panel 1 in such a manner that the connecting box 5 is interconnected to the end of the conduit assembly 4. The insert 51 is received by the chamber of said screen panel 1 and said trim body 2. The rear end of the connecting box 5 is connected with the conduit assembly 4 by a tab 52. A plug socket 8 can be mounted with the rectangular opening 53 if necessary. On the other hand, the supporting leg 6 can be installed onto the screw hole 55 for supporting the screen panel 1.

Figure 4:
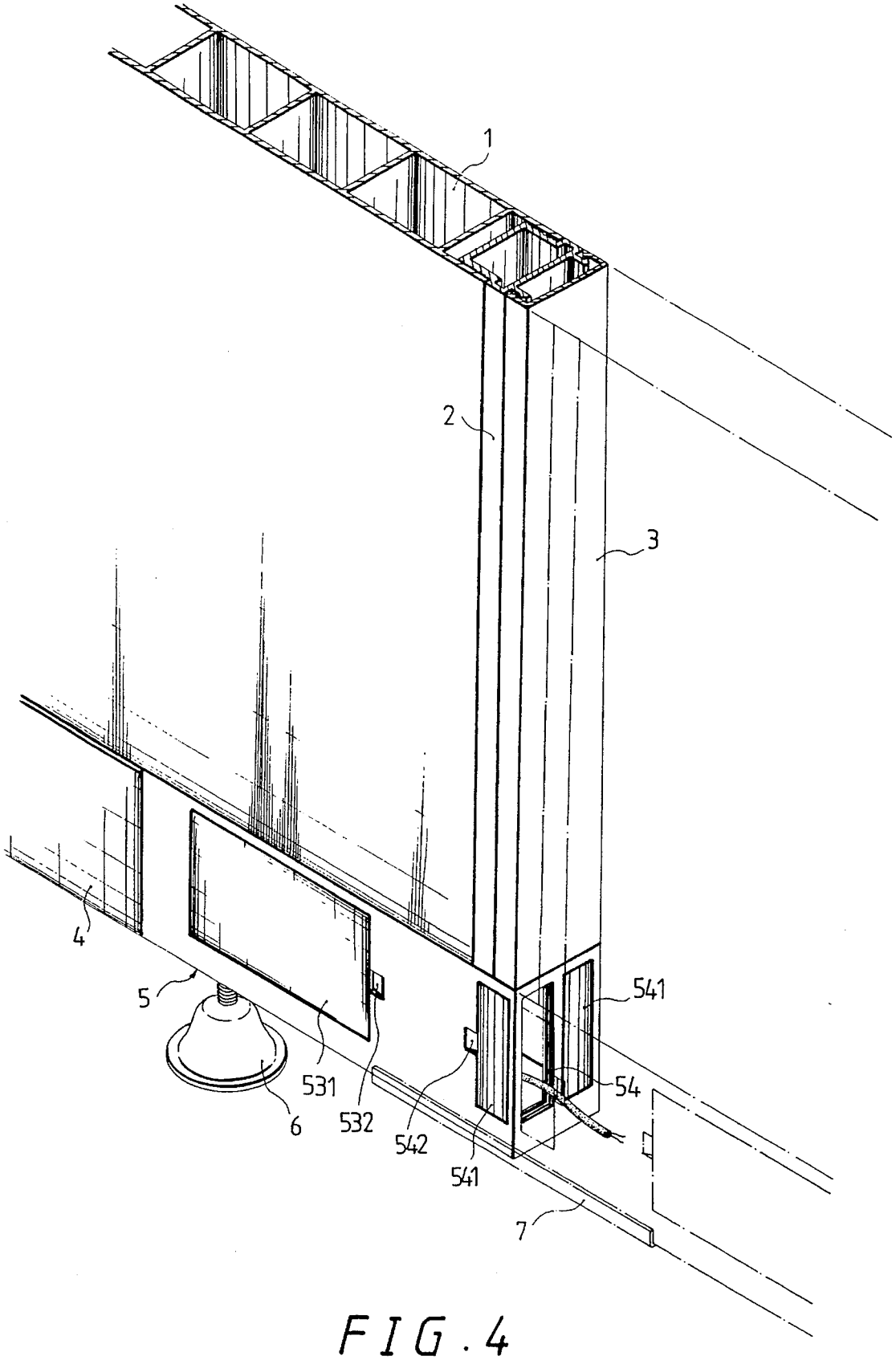
FIG. 4 is still a perspective view of the conduit connecting mechanism connected between two adjacent screen panels.

As shown in FIG. 4, when two adjacent screen panels 1 are linked together in linear configuration, the elongate opening 54 can be opened by removing the elongate lid 541, accordingly, the conduit assemblies 4 of two adjacent screen panels 1 are in communication with each other. Then the connecting plate 7 can be screwed to the screw hole 56 by means of screws.

Figure 5:
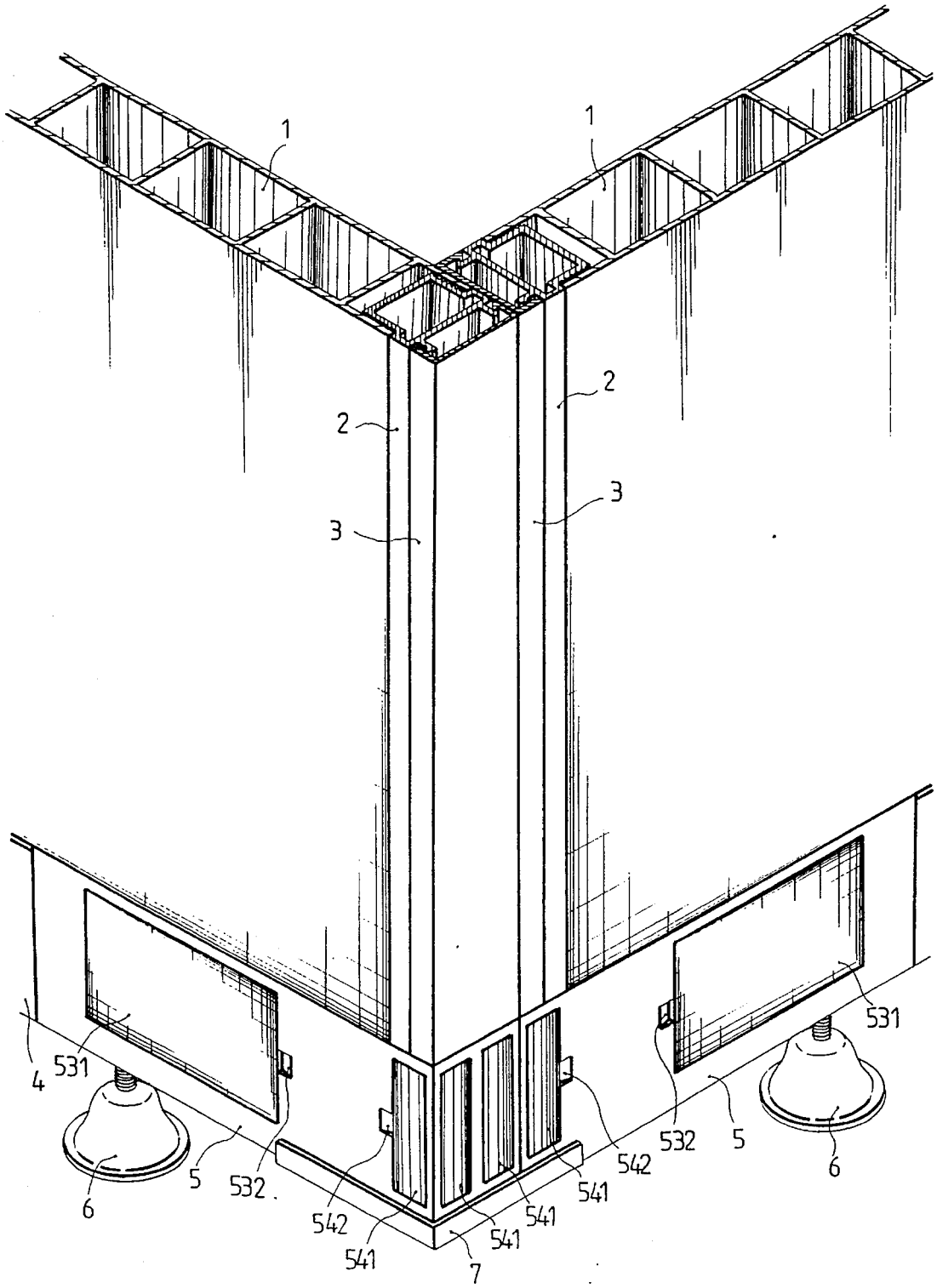
FIG. 5 is still a perspective view of the conduit connecting mechanism connected between two adjacent screen panels in vertical alignment.

As shown in FIG. 5, when two adjacent screen panels 1 are linked together in a right angle alignment, the elongate lid 541 of the elongate opening 54 at a side wall is removed for routing the electric cords. Accordingly, the conduit assemblies 4 of two adjacent screen panels 1 are disposed in communication with each other.

By this arrangement, the connection of two adjacent conduit mechanism can be readily done without compromising the completeness of the screen panel 1.

Besides, an inclined slot 532, 542 is provided at the edge of the rectangular opening 53 and the elongate opening 54 for easy mounting of said lid 531 and said elongate lid 541. Furthermore, the insert 51 of said connecting box 5 can be divided into two parts, each of the divided parts can be received by the chamber of the screen panel 1 and the trim body 2 respectively. Accordingly, an enhanced connection between the trim body 2 and the screen panel 1 is ensured.

Although the present invention has been described in connection with the preferred embodiments thereof, many other variations and modifications will become apparent to those skilled in the art without departing from the scope of the invention. It is preferred, therefore, that the present invention not be limited by the specific disclosure herein, but only by the appended claims.

I claim:

1. A conduit connecting mechanism comprising:

a) a screen panel including an end edge provided with a trim body and a bottom edge provided with a chamber;

b) a conduit assembly secured to the bottom edge of the screen panel for routing a plurality of electric cords therethrough; and c) a substantially rectangular connecting box secured to the bottom edge of the screen panel adjacent the end edge, the connecting box including a rear end in communication with the conduit assembly, a top surface, an insert on the top surface, the insert being interconnected with the chamber of the screen panel and the trim body, a pair of side walls, a frontal wall and at least one rectangular horizontal opening provided in the side walls and at least one elongated vertical opening provided in the frontal wall.

2. The conduit connecting mechanism of claim 1 further including a plug socket detachably mounted to the rectangular horizontal opening and a detachable lid for covering the rectangular horizontal opening when the plug socket is removed therefrom.

3. The conduit connecting mechanism of claim 1 further including a detachable lid for covering the elongated vertical opening when electric cords are not passed therethrough.

4. The conduit connecting mechanism of claim 1 further including a tab means for connecting the conduit assembly and the connecting box.

5. The conduit connecting mechanism of claim 1 wherein the connecting box includes a bottom wall and at least one screw provided in the bottom wall for mounting a supporting leg.

6. The conduit connecting mechanism of claim 1 wherein the connecting box includes a bottom wall and a plurality of positioning holes provided in the bottom wall for mounting a connecting plate of the screen panel.

7. The conduit connecting mechanism of claim 1 wherein the insert on the top surface of the connecting box includes first and second portions, the trim body includes a bottom chamber, the first portion being interconnected with the chamber of the screen panel and the second portion being interconnected with the bottom chamber of the trim body.

* * * * *